United States Patent [19]

Murakami et al.

[11] Patent Number: 4,506,972

[45] Date of Patent: Mar. 26, 1985

[54] DEVELOPING DEVICE WITH MEANS TO PREVENT SCATTERING

[75] Inventors: Reiji Murakami, Yokohama; Kohachi Uchida, Sagamihara; Yoshitsugu Nakatomi, Yokohama; Tomohiko Takahashi, Tokyo, all of Japan

[73] Assignee: Tokyo Shibaura Denki Kabushiki Kaisha, Kawasaki, Japan

[21] Appl. No.: 379,044

[22] Filed: May 17, 1982

[30] Foreign Application Priority Data

May 18, 1981 [JP] Japan ..... 56-74726

[51] Int. Cl.[3] ..... G03G 15/09

[52] U.S. Cl. ..... 355/3 DD; 118/657

[58] Field of Search ..... 355/3 DD, 14 D, 15; 118/652, 657, 658

[56] References Cited

U.S. PATENT DOCUMENTS 3,754,526 8/1973 Caudill ..... 355/3 DD X
4,194,465 3/1980 Tsukamoto et al. ..... 355/3 DD X

FOREIGN PATENT DOCUMENTS 149639 5/1978 Japan ..... 355/15
56-5991 2/1981 Japan .

*Primary Examiner*—A. T. Grimley
*Assistant Examiner*—J. Pendegrass
*Attorney, Agent, or Firm*—Cushman, Darby & Cushman

[57] ABSTRACT

A developing device develops an electrostatic latent image formed on a photosensitive drum by using a magnetic developer. The developing device comprises a body frame having a storage section storing the magnetic developer, a developing roller disposed inside the body frame and including a first section facing the storage section and a second section facing the photosensitive drum, for supplying the magnetic developer in the storage section to the second section through the shift of a magnetic field, whereby the magnetic developer supplied to the second section by the developing roller is attracted to the electrostatic latent image on the photosensitive drum, and an intermediate plate provided in the frame body under the developing roller to bear thereon the magnetic developer dropped from the developing roller.

2 Claims, 16 Drawing Figures

DEVELOPING DEVICE WITH MEANS TO PREVENT SCATTERING

BACKGROUND OF THE INVENTION

The present invention relates to a developing device for developing by using a developer an electrostatic latent image formed on an image carrier, more specifically to a developing device for developing the electrostatic latent image by using a magnetic developer.

A copying apparatus using a one-component magnetic developer (hereinafter referred to as magnetic toner) includes a developing device in which an electrostatic latent image formed on the surface of an image carrier (hereinafter referred to as photosensitive body), such as a selenium drum, is supplied with the magnetic toner to be developed.

Conventionally, the developing device includes supply means (hereinafter referred to as developing roller) which is composed of a hollow cylindrical rotating body formed of a nonmagnetic material such as aluminum, and a magnet roller to rotate inside the rotating body in the opposite direction to the rotating direction of the rotating body, for uniform development. FIG. 1 shows a conventional example of the developing device of this type.

In FIG. 1, reference numeral 1 designates a body frame of the developing device. The body frame 1 includes a first casing 2 having a doctor blade 2*a*, a second casing 3 opposed to the first casing 2 with a space between them, and a pair of side frames 4 to which both end portions of the first and second casings 2 and 3 are fixed severally. The body frame 1 has an opening 1*a* for supply at the upper side thereof and an opening 1*b* for development at one side thereof. A developing roller 5 is rotatably disposed inside the body frame 1. Part of the developing roller 5 is exposed to the outside through the developing opening 1*b*. Magnetic toner supplied through the supply opening 1*a* is stored at that portion of the inside space of the body frame 1 which is above the developing roller 5. The end portion of the second casing 3 on the side of the developing opening 1*b* is defined as a toner receiving section 3*a*.

The developing roller 5 includes a cylindrical rotating body (hereinafter referred to as sleeve) 5*a* made of a nonmagnetic material such as aluminum, and a magnet roller 5*b* disposed inside the sleeve 5*a*. The sleeve 5*a* is rotated by suitable means in the counterclockwise direction indicated by an arrow A in FIG. 1, and the magnet roller 5*b* rotates in the clockwise direction indicated by an arrow B in synchronism with the rotation of the sleeve 5*a*. A narrow gap 7 of a given width is defined between the outer peripheral surface of the sleeve 5*a* and a photosensitive drum 6 to rotate in the clockwise direction indicated by an arrow C in FIG. 1.

In such a developing device, the magnetic toner is adsorbed on the outer peripheral surface of the sleeve 5*a* by the magnetic force of the magnet roller 5*b*, and carried in the direction indicated by the arrow A. At this time, the magnet roller 5*b* is rotating in the opposite direction to the rotating direction of the sleeve 5*a*, so that the magnetic toner adsorbed on the sleeve 5*a* take the form of soft brushes standing substantially upright on the outer peripheral surface of the sleeve 5*a*. Then, the magnetic toner carried in this manner is attracted through the gap 7 to an electrostatic latent image formed on the surface of the photosensitive drum 6, in accordance with the surface potential of the image, and thus the image is developed satisfactorily.

The development does not require the use of all the magnetic toner on the sleeve 5*a*. That portion of the magnetic toner which remains on the sleeve 5*a* without having played a part in the development collected again in the body frame 1 by suitable means. A small amount of magnetic toner would, however, fall on to the toner receiving section 3*a* of the second casing 3 to accumulate therein.

In this prior art developing device, however, the magnet roller 5*b* rotates in the direction indicated by the arrow B, so that the magnetic toner accumulated in the toner receiving section 3*a* is moved toward the developing opening 1*b* and delivered to the outside of the second casing 3. Thereafter, the magnetic toner tends to drop and scatter as it moves away from the magnetic force of the magnet roller 5*b*. The scattered toner would soil peripheral devices to deteriorate the quality of copied pictures.

SUMMARY OF THE INVENTION

The present invention is contrived in consideration of above mentioned circumstances, and is intended to provide a developing device capable of preventing magnetic toner from scattering therefrom, and hence of producing high-resolution pictures and improving the reliability of picture formation process.

According to an aspect of the present invention, there is provided a developing device which develops by using a magnetic developer an electrostatic latent image formed on an image carrier, the developing device comprising a body frame having a storage section storing the magnetic developer, supply means disposed inside the body frame and including a first section facing the storage section and a second section facing the image carrier, for supplying the magnetic developer in the storage section to the second section through the shift of a magnetic field, whereby the magnetic developer supplied to the second section by the supply means is attracted to the electrostatic latent image on the image carrier, and scattering preventive means provided in the frame body for preventing scattering of that portion of the magnetic developer which has no part in the developing operation, the scattering preventive means including a plate member disposed under the supply means to bear thereon the magnetic developer dropped from the supply means.

DETAILED DESCRIPTION OF THE PREFERRED EMBODIMENT

Referring now to the accompanying drawings of FIGS. 2 to 12, there will be described in detail one embodiment of a developing device according to the present invention which is applied to an electrostatic copying apparatus.

Figure 1:
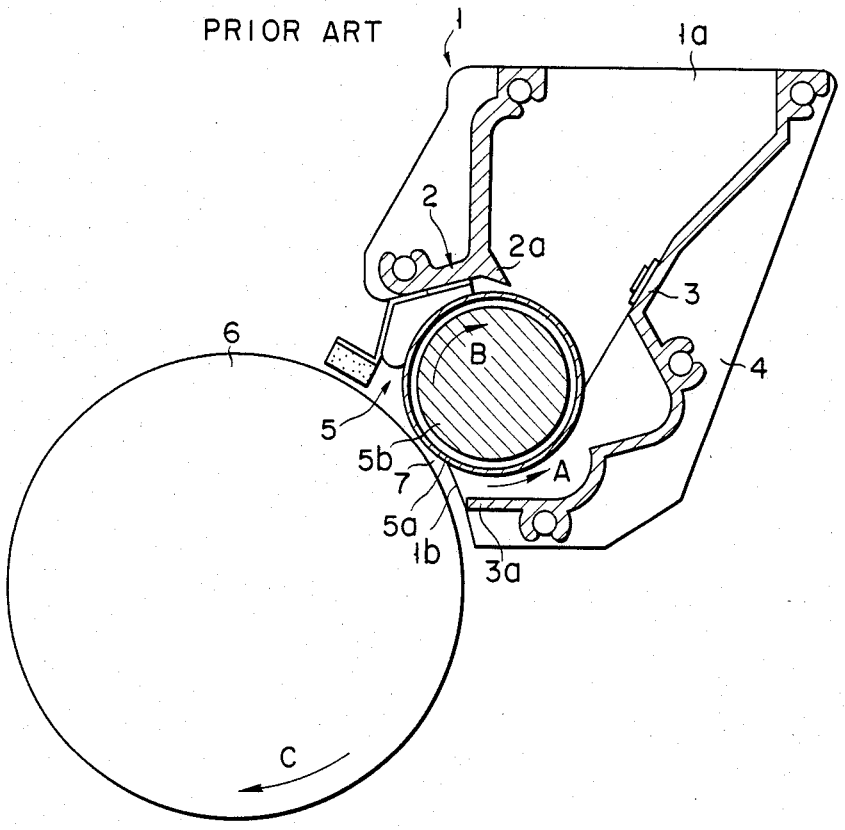
FIG. 1 PRIOR ART
FIG. 1 is a sectional view of a prior art developing device.
Figure 2:
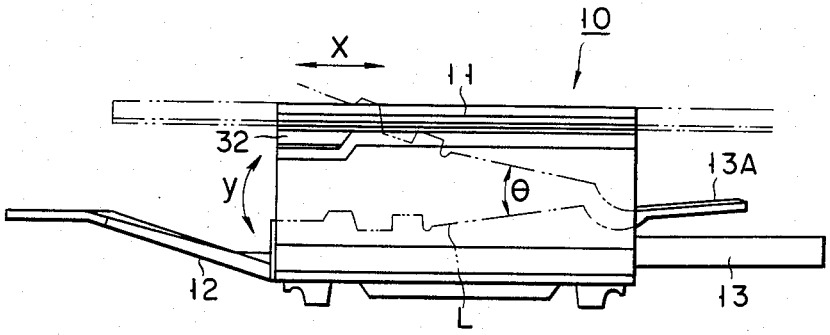
FIG. 2 is a side view schematically showing an electrostatic copying apparatus provided with a developing device according to the present invention.
Figure 3:
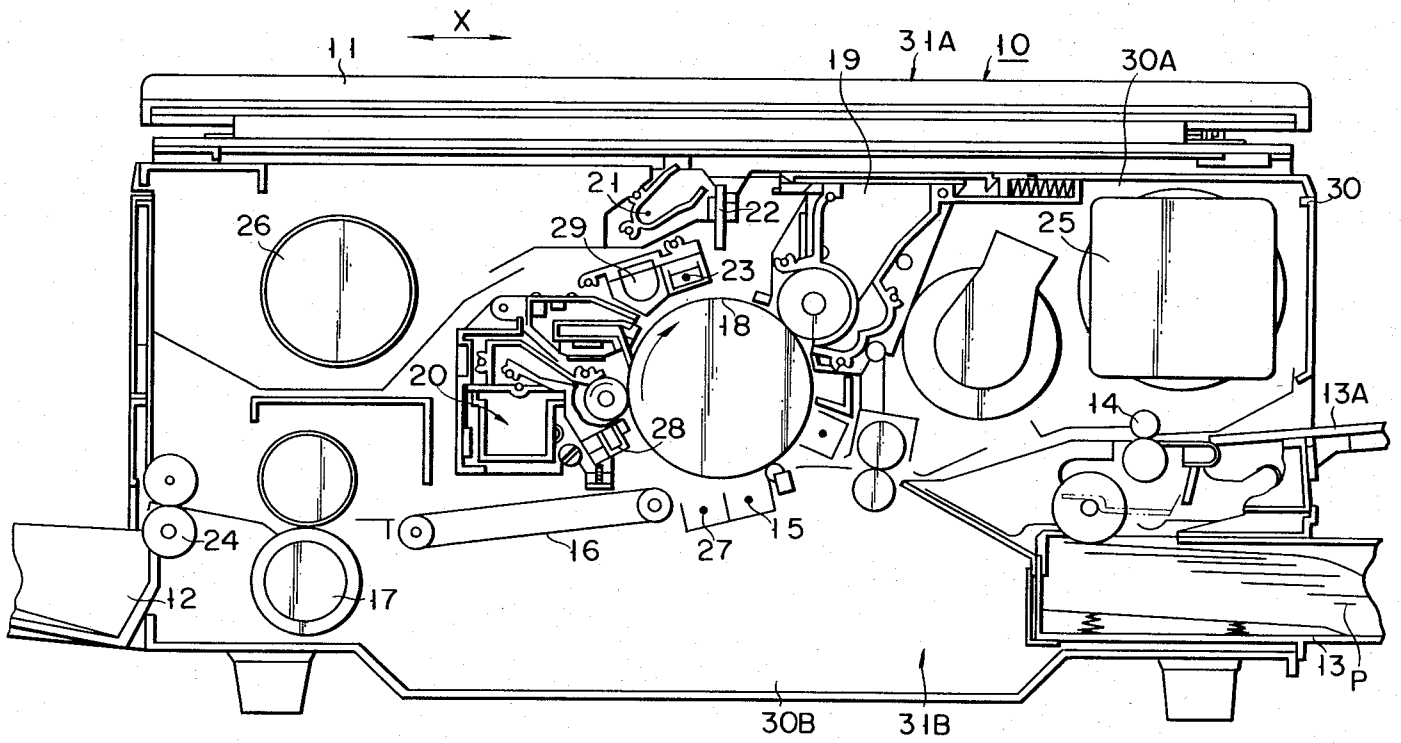
FIG. 3 is a side view schematically showing the internal structure of the electrostatic copying apparatus shown in FIG. 2.

In FIGS. 2 and 3, reference numeral 10 designates an electrostatic copying apparatus. The electrostatic copying apparatus 10 has a housing 30, as described in detail later, which is provided with a document table 11 on the top. The document table 11 can freely reciprocate, as required, along the direction indicated by an arrow X. Attached to the left side portion (in FIGS. 2 and 3) of the housing 30 is a detachable tray 12 into which copying paper is discharged after copying. Detachably arranged on the right side of the housing 30 are a cassette 13 storing a pile of copying paper P and a guide member 13A for manual feeding. Contained in the housing 30, as shown in FIG. 3, are a paper feeding mechanism 14 for feeding the copying paper or sheets P from the cassette 13 or the manual feeding guide member 13A, a transfer mechanism 15 for transferring magnetic toner image onto the copying paper P, a conveyor mechanism 16 for conveying the copying paper P after transcription, a fixing mechanism 17 for fixing the transferred magnetic toner image on the copying paper P, a photosensitive drum 18 having a photosensitive layer formed of selenium or the like, a developing device 19 for developing by means of the magnetic toner an electrostatic latent image formed on the photosensitive layer of the photosensitive drum 18, a cleaning device 20 for cleaning the surface of the photosensitive drum 18, an illumination system for lighting up an original document put on the document table 11, a convergent light transmitting body 22 for transmitting light from the illumination system 21 reflected by the original document onto the photosensitive layer of the photosensitive drum 18, a charger 23 for charging the photosensitive layer, a conveyor roller 24 for discharging the fixed copying paper P into the tray 12, and a motor 25 for synchronously moving and rotating the document table 11 and the photosensitive drum 18, respectively. A cooling device 26 for cooling heat generating parts is disposed at the left side portion of FIG. 3. Further, an absence-of-paper detector (not shown) is disposed over the cassette 13, and a jam detector (e.g., microswitch, not shown) is located on the left of the fixing mechanism 17. In FIG. 3, reference numerals 27, 28 and 29 designate a paper separator, a de-electrifier, and a pre-charging exposure lamp, respectively.

The housing 30 of the copying apparatus 10 is composed of upper and lower frames 30A and 30B which are pivotally mounted on each other at their respective one end portions. The upper frame 30A can be rocked around a pivotal portion through a desired angle $\theta$ (e.g., 25°) from the lower frame 30B. The photosensitive drum 18, cleaning device 20, developing device 19, and document table 11 are attached to the upper frame 30A by suitable means to form an upper unit 31A, while the cassette 13, transfer mechanism 15, fixing mechanism 17, and tray 12 are attached to the lower frame 30B by suitable means to form a lower unit 31B. After a control board 32 shown in FIG. 2 is rocked and removed, the upper frame 30A can be rocked in the direction indicated by an arrow Y with respect to a conveyor path L of the copying paper P by means of a housing rocking device (not shown). Thus, if the conveyor path L is jammed with the copying paper P, the paper P can be removed with ease.

In the electrostatic copying apparatus constructed in this way, the original document put on the document table 11 is lit up by the illumination system 21, and reflected light from the original is led on to the photosensitive layer of the photosensitive drum 18 through the convergent light transmitting body 22. Thereafter, the copying sheets P from the cassette 13 or the manual feeding guide member 13A are taken out one by one into the housing 30 by the paper feeding mechanism 14. Each copying sheet P is led to the lower portion of the photosensitive drum 18, and toner image on the photosensitive layer developed by the magnetic toner in the developing device 19 is transferred onto the copying sheet P by the transfer mechanism 15. After the transcription, the copying sheet P is delivered into the fixing mechanism 17 via the conveyor mechanism 16. After fixed in the fixing mechanism 17, the copied sheet P is discharged into the tray 12 by the conveyor roller 20. After the transcription is ended, moreover, the photosensitive drum 18 is de-electrified by the de-electrifier 28 and cleaned by the cleaning device 20. Thus, a series of copying processes is completed.

The developing device 19 will now be described in detail.

Figure 4:
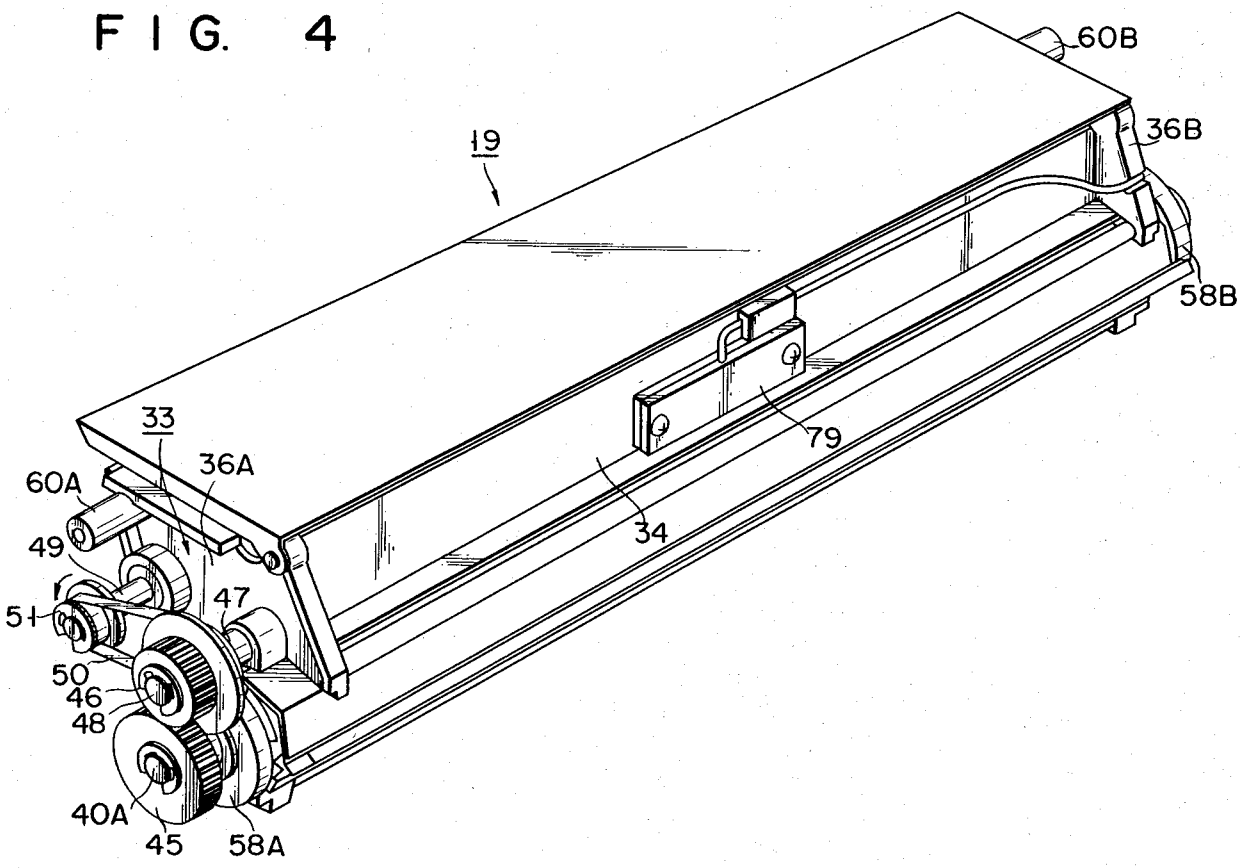
FIG. 4 is a perspective view of one embodiment of the developing device according to the invention.
Figure 5:
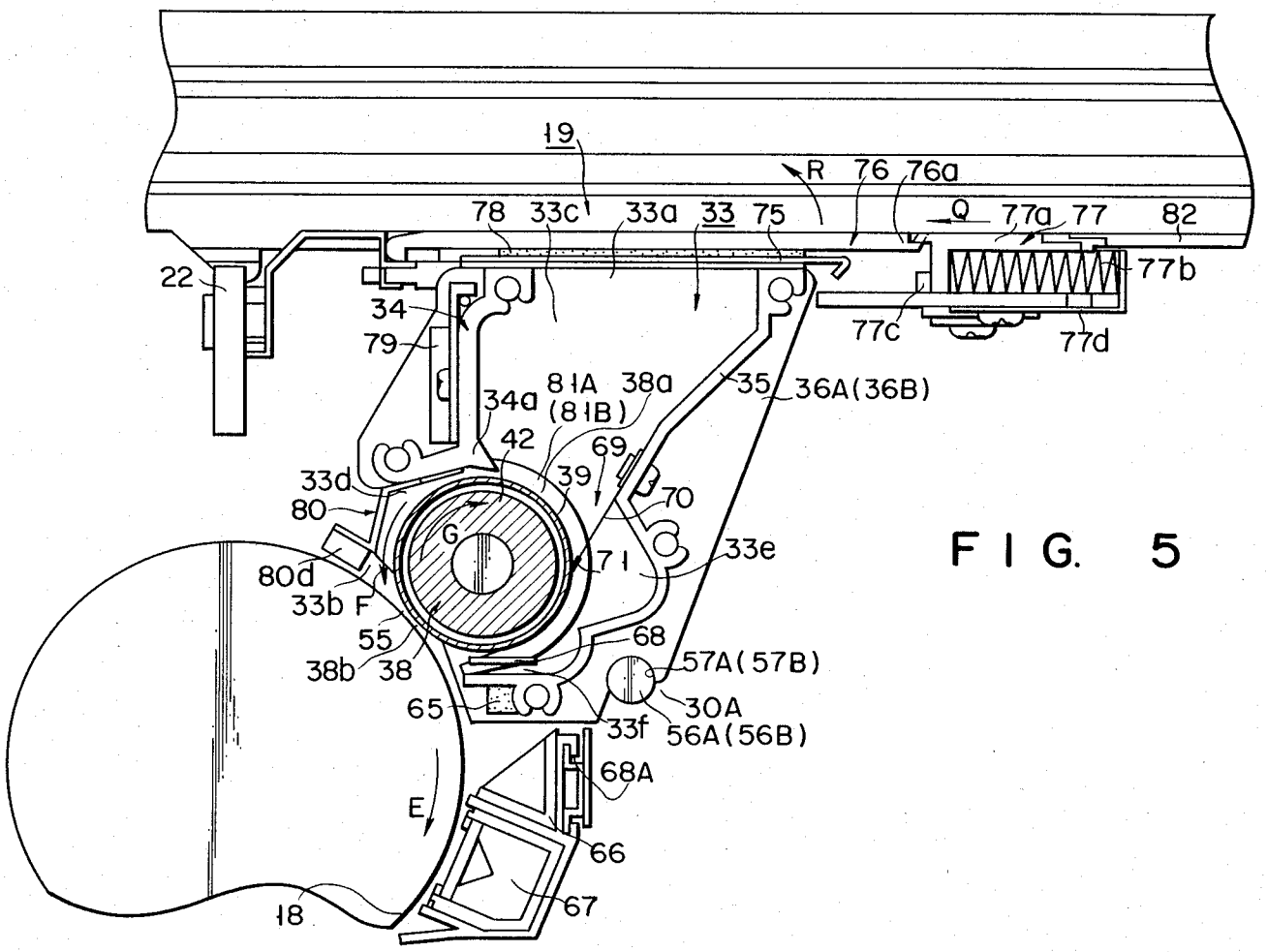
FIG. 5 is a side view of the developing device.

Referring first to FIGS. 4 and 5, there will be described the construction of a body frame 33 of the developing device 19. The body frame 33 integrally includes a first casing 34, a second casing 35 facing the first casing 34 at a distance, and a pair of side frames 36A and 36B to which both ends of the casings 34 and 35 are fixed severally. As shown in FIG. 5, a supply opening 33*a* for supplying the magnetic toner is formed at the upper end portion of the body frame 33, and an opening 33*b* for developing is defined at the lower left end portion. Inside the body frame 33 thus constructed, there are formed a toner storage section 33*c*, a developing roller housing section 33*d*, a temporary toner storage section 33*e*, and a toner receiving section 33*f*. A doctor blade 34*a* is formed integrally with the first casing 34 at the corner portion thereof, projecting inwardly therefrom. The doctor blade 34*a* is intended to uniformalize the amount of magnetic toner carried by a developing roller 38 as mentioned later. For higher accuracy of the shape and dimensions of the doctor blade 34*a*, the first casing 34 including the doctor blade 34*a* is manufactured by extrusion molding of aluminum, for example. By doing this, the first casing 34 may be improved expressly in replaceability.

Figure 6:
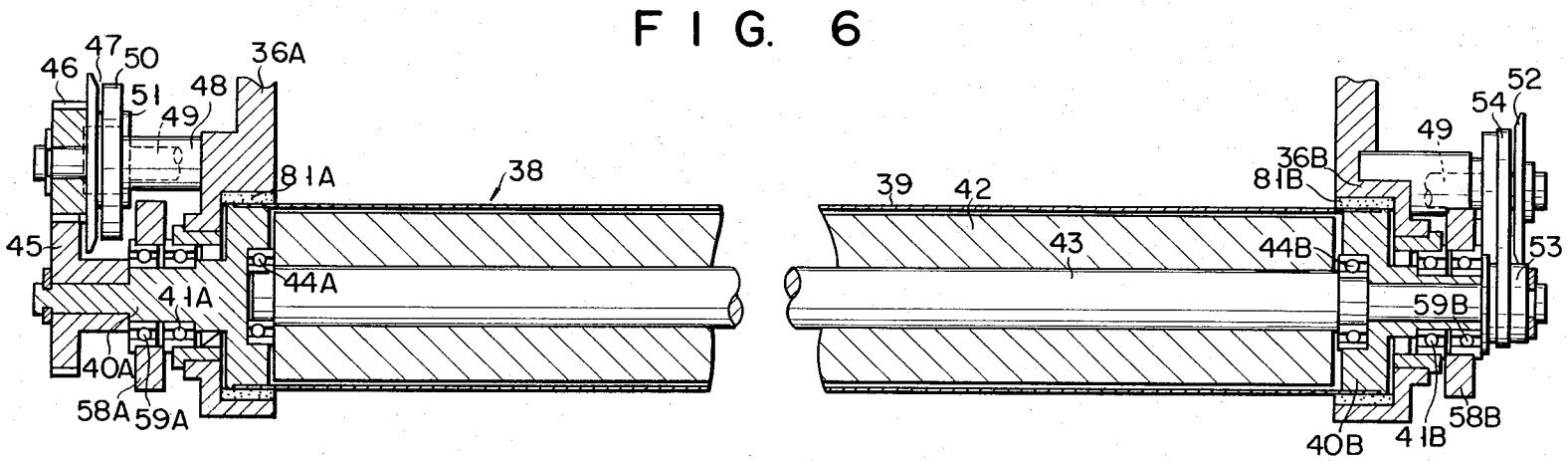
FIG. 6 is a longitudinal-sectional view of a developing roller of the developing device.
Figure 7:
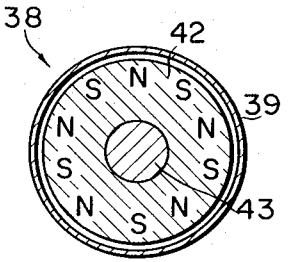
FIG. 7 is a cross-sectional view of the developing roller.

Referring now to FIGS. 5 to 7, there will be described the developing roller 38 contained in the developing roller housing section 33*d*. As shown in FIG. 6, the developing roller 38 includes a hollow cylindrical rotating body (hereinafter referred to as sleeve) 39 made of a nonmagnetic material such as aluminum, and a magnet roller 42 fitted in the hollow space inside the sleeve 39. One part 38*a* of the developing roller 38 is positioned with the toner storage section 33*c* and the other part 38*b* of the developing roller 38 is facing the photosensitive drum 18 through the opening 33*b*. A pair of stepped shafts 40A and 40B are concentrically fixed to their corresponding ends of the sleeve 39 by means of flange portions. The stepped shafts 40A and 40B are rotatably mounted on the side frames 36A and 36B by means of ball bearings 41A and 41B, respectively. A shaft 43 axially fixedly pierces the central portion of the magnet roller 42. Both end portions of the shaft 43 are rotatably attached to the stepped shafts 40A and 40B by means of ball bearings 44A and 44B, respectively. The other end portion of the shaft is projecting from the stepped shaft 40B. Thus, the magnet roller 42 and the sleeve 39 are so supported as to be able to rotate independently of each other. In the magnet roller 42, as shown in FIG. 7, a plurality of N and S poles are alternately arranged at equal spaces in a ring, and lines of magnetic force are formed around the sleeve 39 substantially at right angles thereto.

The stepped shaft 40A is fitted with a driving gear 45 for rotating the sleeve 39 in the direction indicated by an arrow F in FIG. 5. The driving gear 45 is supplied with power from a suitable driving source (not shown). In order to rotate the magnet roller 42 in the opposite direction to the rotating direction of the sleeve 39, that is, in the direction indicated by an arrow G in FIG. 5, the side frame 36A is fitted with an intermediate rod 48 on which an idle gear 46 in mesh with the driving gear 45 and a first pulley 47 capable of coaxially rotating in a body with the idle gear 46 are fitted rotatably, as shown in FIGS. 4 and 6. Adjoining the intermediate rod 48, a sub-shaft 49 rotatably penetrates the pair of side frames 36A and 36B. A second pulley 51 to which a driving force from the first pulley 47 is transmitted by means of a timing belt 50 is fixed to one end portion of the sub-shaft 49 on the side of the side frame 39A. As shown in FIG. 6, moreover, a third pulley 52 is fixed to the other end portion of the sub-shaft 49 on the side of the side frame 36B. As shown in FIG. 6, furthermore, a fourth pulley 53 is fixed to the other end portion of the shaft 43 projecting from the stepped shaft 40B. Power from the third pulley 52 is transmitted to the fourth pulley 53 by means of a timing belt 54. Since the idle gear 46 is thus interposed between the driving gear 45 and the second pulley 51, each of the stepped shafts 40A and 40B and the sub-shaft 49 rotate in opposite directions, so that the rotation of the sub-shaft 49 is transmitted to the shaft 43 as it is. After all, the sleeve 39 and the magnet roller 42 can rotate in opposite directions.

In the developing roller 38 of such construction, as shown in FIG. 5, whereas the photosensitive drum 18 rotates in the clockwise direction indicated by an arrow E, the sleeve 39 rotates in the counterclockwise direction indicated by the arrow F, and the magnet roller 42, on the other hand, rotates in the clockwise direction indicated by the arrow G. Part of the developing roller 38 is exposed to the outside through the developing opening 33*b* formed in the body frame 33, and a narrow gap 55 is defined between the outer peripheral surface of the photosensitive drum 18 and that of the sleeve 39, as mentioned later. Thus, the magnetic toner stored in the toner storage section 33*c* is attracted to the sleeve 39 by the magnetic force of the magnet roller 42 to form soft brushes standing upright on the outer peripheral surface of the sleeve 39. The attracted magnetic toner is carried in the direction indicated by the arrow F as the sleeve 39 rotates. Then, the magnetic toner is attracted through the gap 55 to the electrostatic latent image on the surface of the photosensitive layer on the basis of the surface potential of the electrostatic latent image, and the electrostatic latent image is developed by the magnetic toner. The doctor blade 34*a* is so located as not to hinder the removal of the developing roller 38 through the developing opening 33*b*. For the maintenance of the developing roller 38, therefore, it is unnecessary to detach the first casing 34 from the side frames 36A and 36B.

Turning now to FIGS. 4 to 6 and 8, there will be described a structure for locating the body frame 33 to define the gap 55. First, as shown in FIG. 5, a pin 56A is attached to the upper frame 30A of the housing 30. The side frame 36A is provided with a fitting portion 57A in which the pin 56A is fitted detachably. Likewise, a pin 56B is attached to the upper frame 30A so as to face the pin 56A, and the side frame 36B is provided with a fitting portion 57B in which the pin 56B is fitted detachably. The fitting portion 57B is located opposite to the fitting portion 57A.

Then, as shown in FIG. 6, a pair of adjusting rollers 58A and 58B are rotatably mounted on the stepped shafts 40A and 40B through the ball bearings 59A and 59B, respectively, whereby the gap 55 shown in FIG. 5 is regulated in width. Each of the adjusting rollers 58A and 58B has a size slightly greater than the sleeve 39 in outside diameter, and is allowed freely to rotate in contact with the outer peripheral surface of the photosensitive drum 18. Thus, the gap 55 can have a fixed width.

Figure 8:
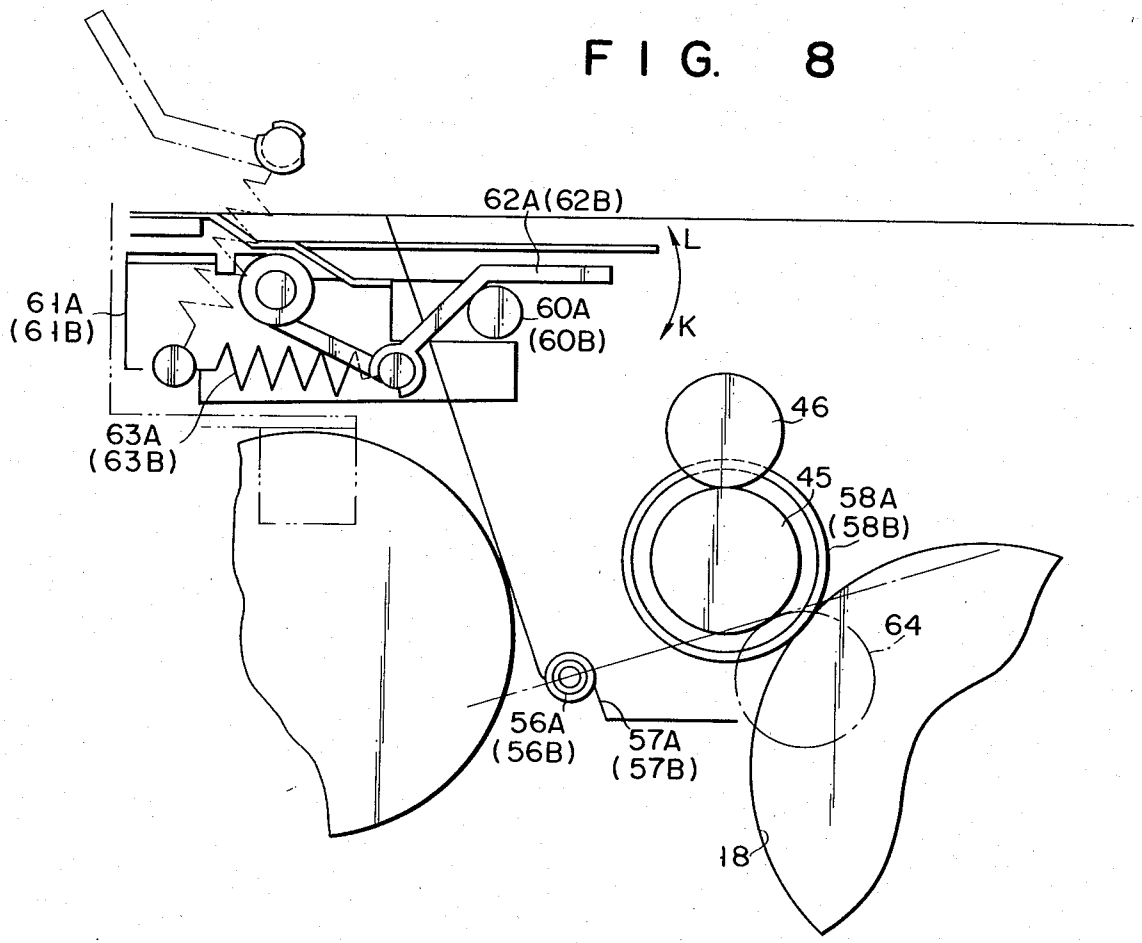
FIG. 8 is a side view schematically showing an arrangement for locating the developing device.

In order to fix securely the body frame 33 located by the aforementioned structure, the side frames 36A and 36B are provided with a pair of stopper rods 60A and 60B, respectively, as shown in FIG. 4. As shown in FIG. 8, the stopper rods 60A and 60B are so designed as to abut against stopper levers 62A and 62B which are rotatably mounted on a pair of holders 61A and 61B opposed to the upper frame 30A. The stopper levers 62A and 62B are urged to rock in the direction indicated by an arrow K in FIG. 8 by coil springs 63A and 63B, respectively. Urged in this manner, the body frame 33 is fixed firmly to the upper frame 30A by means of the adjusting rollers 58A and 58B and the fitting portions 57*a* and 57B.

The body frame 33 can be removed upwardly (in FIG. 8) with ease from the upper frame 30A by rocking the stopper levers 62A and 62B in the direction indicated by an arrow L in FIG. 8 to disengaged them from the stopper rods 60A and 60B. The central axis of the pin 56A is aligned with the direction of the pressure angle of the engagement between the driving gear 45 for driving the developing roller 38 and a transmission gear 64 for transmitting power from a driving source (not shown) to the driving gear 45, as shown in FIG. 8, least such engagement should produce moment in the body frame 33. By doing this, the body frame 33 may be kept from vibration or deflection.

Referring now to FIG. 5, there will be described a structure for preventing scattering of magnetic toner which remains on the outer peripheral surface of the sleeve 39 after development, and then falls into the toner receiving section 33*f* to accumulate therein. As shown in FIG. 5, a polyurethane foam 65 is attached to the under side of the toner receiving section 33*f* along the longitudinal direction thereof, to pick up the magnetic toner which is led to the outside of the toner receiving section 33*f* by the agency of the magnetic force of the magnet roller 42 rotating in the direction indicated by the arrow G in FIG. 5. Also, the polyurethane foam 65 functions as a stopper for preventing the magnetic toner outside the toner receiving section 33*f* from scattering extensively. Disposed under the polyurethane foam 65, as shown in FIG. 5, is a retaining receptacle 66 for receiving and retaining the magnetic toner which falls from the polyurethane foam 65 when the polyurethane foam 65 is saturated and disabled from picking up the magnetic toner any more. The retaining receptacle 66 is integrally fitted with a charger 67 for de-electrification on the bottom. Further, the retaining receptacle 66 can be attached to and detached from the structure by means of a holder 68A which is mounted on the upper frame 30A of the housing 30. You might remove the retaining receptacle 66 by drawing it out together with the de-electrifying charger 67 with your hand on the holder 68A. Thus facilitated, the removal of the retaining receptacle 66 will never cause the magnetic toner to scatter. Since the retaining receptacle 66 can be removed together with the de-electrifying charger 67, moreover, cleaning of the charger 67 and disposal of the magnetic toner can be done at the same time for easier and more efficient maintenance.

Figure 9:
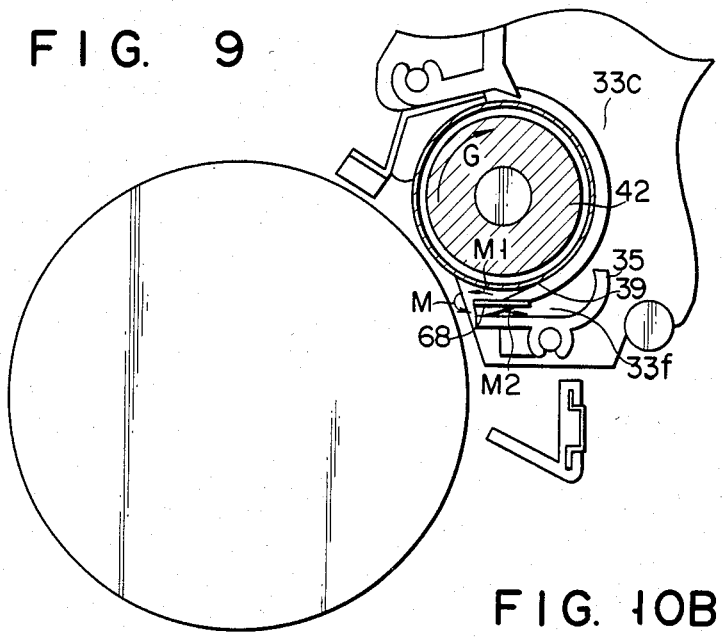
FIG. 9 is a side view showing the structure of an intermediate plate.
Figure 10B:
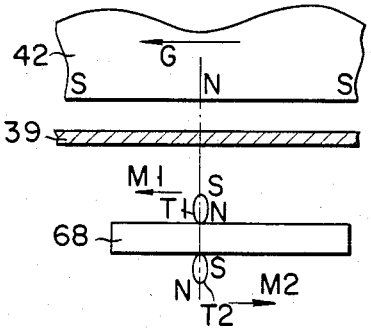
FIGS. 10A through 10C are schematic side views for illustrating the function of the intermediate plate.
Figure 10A:
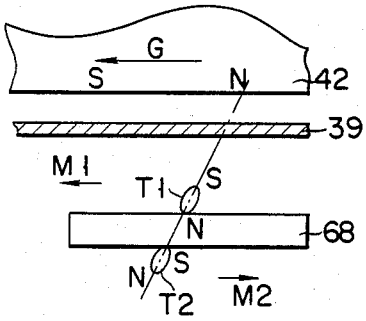
Figure 10C:
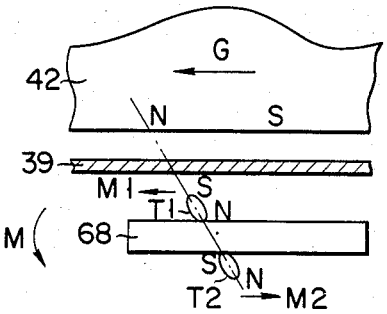
Figure 11A:
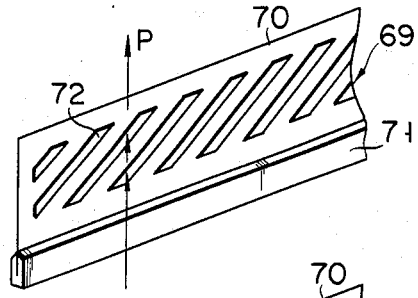
FIG. 11A is a perspective view of a scraper blade.
Figure 11B:
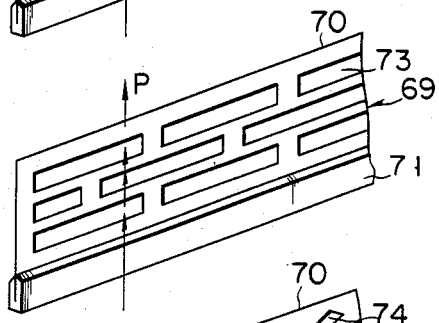
FIGS. 11B and 11C are perspective views showing first and second modifications, respectively, of the scraper blade.
Figure 11C:
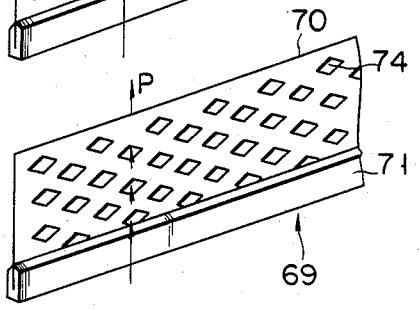

For securer prevention of the scattering of the magnetic toner, moreover, there is used such an arrangement as shown in FIGS. 5 and 9, which constitutes a characteristic feature of the present invention. Namely, at the toner receiving section 33*f*, an intermediate plate 68 formed of a nonmagnetic material is horizontally disposed along the axial direction of the sleeve 39 without being in contact with the sleeve 39 and the second casing 35. Alternatively, the intermediate plate 68 may be inclined. By the use of the intermediate plate 68, the magnetic toner slipping off the outer peripheral surface of the sleeve 39 is bound to fall on to the top surface of the intermediate plate 68. The magnetic toner dropped on the intermediate plate 68 rollingly moves on its top surface in the direction indicated by an arrow M1 by the agency of the magnetic force of the magnetic roller 42 which rotates in the direction of the arrow G, as shown in FIG. 10A. Namely, in FIG. 10A, a toner particle T1, along with a toner particle T2, is magnetized to establish south and north poles therein as each north pole of the magnet roller 42 approaches it. As the magnet roller 42 moves in the direction indicated by the arrow G, the toner particle T1 rocks around its end portion on the north pole side, as shown in FIGS. 10B and 10C. Influenced by a south pole of the magnet roller 42 approaching in the next stage, the toner particle T1 rotates counterclockwise to be inclined, as shown in FIG. 10B. Meanwhile, the toner particle T2 held on the under surface of the intermediate plate 68 by an electrostatic force between the toner particle T2 and the plate acts in the same manner as the toner particle T1, rollingly moving in the direction indicated by an arrow M2.

The toner particle T1 reaching the end portion of the intermediate plate 68 on the lower-course side, with respect to the rotating direction G of the magnet roller 42, turns around in the direction indicated by the arrow M to appear on the under surface of the intermediate plate 68. Further, the toner particle T1, like the toner particle T2, rollingly moves while being held on the under surface of the intermediate plate 68 by an electrostatic force between the toner particle T1 and the plate, and thus circulates along the outer periphery of the intermediate plate 68 as the magnet roller 42 rotates. If the magnetic toner circulating in this manner increases, it is attracted again from the top surface of the intermediate plate 68 to the outer peripheral surface of the sleeve 39 by the magnetic force of the magnet roller 42, and is collected in the toner storage section 33*c*. Thus, the use of the intermediate plate 68 can prevent the magnetic toner from scattering from the toner receiving section 33*f*. The polyurethane foam 65, the retaining receptacle 66, and the intermediate plate 68, which functions as the stopper to pick up the magnetic toner and prevent the scattering thereof, as described above, constitute a toner leakage preventive member.

Referring now to FIGS. 5 and 11A to 11C, there will be described the construction of a scraper blade 69 for scraping off the magnetic toner remaining on the outer peripheral surface of the sleeve 39 after development. In the scraper blade 69 shown in FIG. 11A, for example, reference numeral 70 designates a rectangular support plate of an elastic material which has one major side of a length substantially equivalent to the axial length of the sleeve 39. The other major side portion of the support plate 70 is fitted with a protective member 71 which is softer than the sleeve 39 and lubricative. Available as the material for the protective member 71 are fluoric resins, silicone rubber, urethane rubber, polyester resins, etc., for example. The support plate 70 is provided with toner passage holes, e.g., a number of parallel slits 72 inclined at a given angle to the major sides of the support plate 70. As shown in FIG. 5, the scraper blade 69 is attached to that portion of the second casing 35 which is located over the temporary toner storage section 33*e*. The protective member 71 is so designed as to be uniformly elastically pressed against the outer peripheral surface of the sleeve 39 by the support plate 70. In the scraper blade 69 thus arranged, the protective member 71 scrapes off the magnetic toner remaining on the outer peripheral surface of the sleeve 39 rotating in the direction indicated by the arrow F in FIG. 5. Softer than the sleeve 39 and lubricative, the protective member 71 never damages the outer peripheral surface of the sleeve 39, and can attenuate the force applied to the support plate 70 through the rotation of the sleeve 39. The scraped magnetic toner is temporarily stored in the space forming the temporary toner storage section 33*e*. The stored magnetic toner is moved upward (in FIG. 5) by the magnetic force from the magnet roller 42. The moved magnetic toner passes through the slits 72 in the support plate 70 to be collected in the toner storage section 33*c*. As the magnetic toner passes through the slits 72, it moves from the outside of the support plate 70 to the inside substantially in the direction indicated by an arrow P in FIG. 11A. Thus, the amount of the magnetic toner passing through the slits 72 can be made uniform, because the slits 72 are inclined to the protective member 71. The toner passage holes are not limited to the slits 72. As shown as a first modification in FIG. 11B, for example, the slits 72 may be replaced with a plurality of short parallel slits 73 arranged alternately in a few regular layers. Alternatively, as shown as a second modification in FIG. 11C, the slits 72 may be replaced with coarse meshes 74. In short, the toner passage holes need only be so designed that the spaces of the holes appearing in any section of the support plate 70 taken along the moving direction P of the magnetic toner are discontinuous and substantially equal in size.

Figure 12:
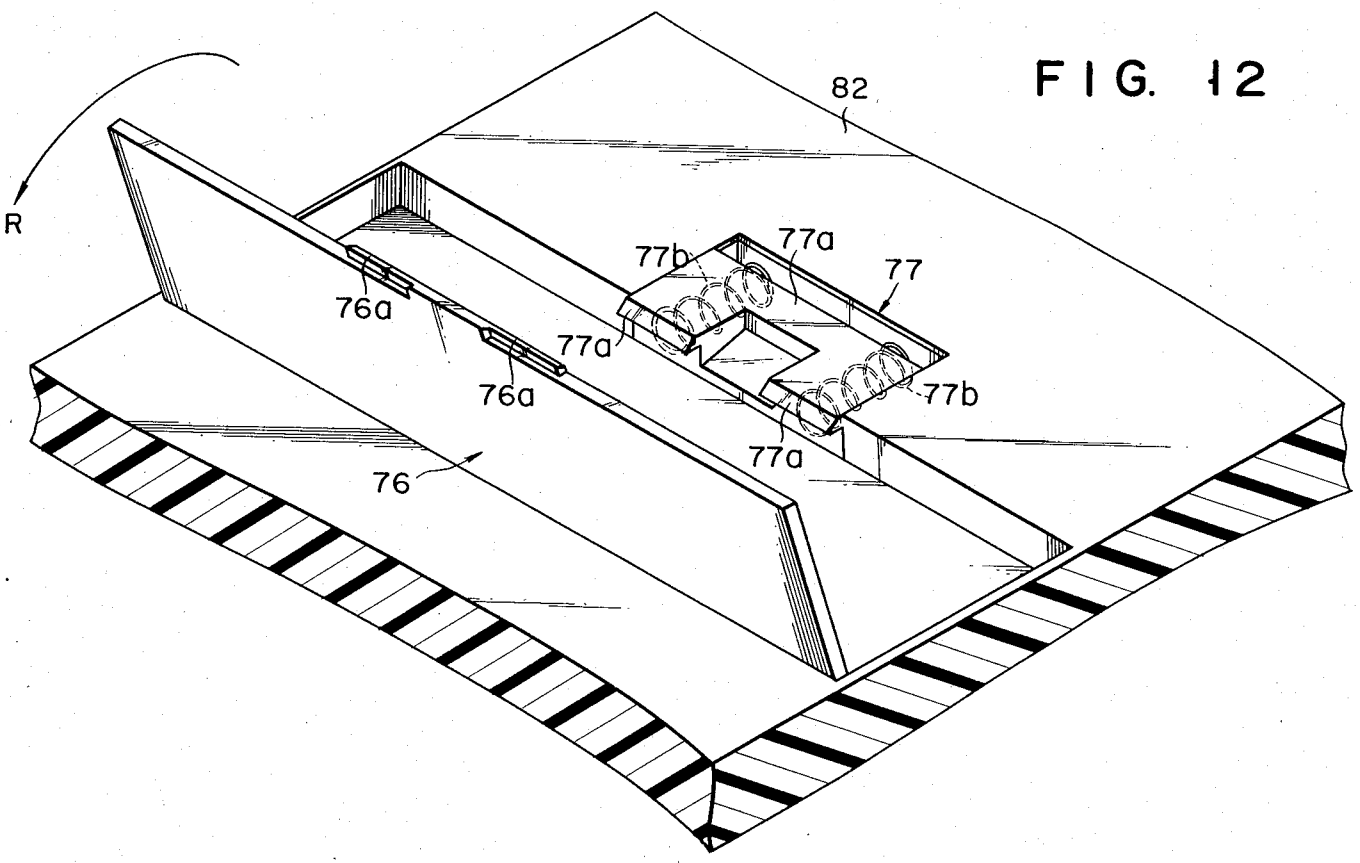
FIG. 12 is a perspective view of a cover member.

Referring now to FIGS. 5 and 12, there will be described a structure for preventing the magnetic toner from scattering in the vicinity of the supply opening 33*a* in the body frame 33. In FIG. 5, reference numeral 75 designates a first cover member. The cover member 75 has a shape and dimensions suited and enough to cover the supply opening 33*a*, and is mounted on the body frame 33 so as to be swingable around its left side end portion in FIG. 5. When shut down, the first cover member 72 is fixed to the body frame 33 by means of a magnet (not shown) or the like. In FIGS. 5 and 12, reference numeral 76 designates a second cover member. The second cover member 76 has such a shape and dimensions that it may cover the first cover member 75 and constitute part of a cover for the upper frame 30A. The second cover member 76 is pivotally mounted on the upper frame 30A so as to be swingable around its left side end portion in FIG. 5 in the position where it can cover the top surface of the first cover member 75. As shown in FIG. 5, moreover, a hook portion 76*a* is formed at the right end portion of the second cover member 76.

The hook portion 76*a* is so designed as to be stopped by a stopper 77. The stopper 77 includes a slider 77*a* to engage the hook portion 76*a*, a coil spring 77*b* for urging the slider 77*a* to slide in the direction indicated by an arrow Q, a projection 77*c* for stopping a predetermined position the slider 77*a* urged by the coil spring 77*b*, and a holder 77*d* holding the coil spring 77*b*. The stopper 77 is attached to a predetermined portion of the upper frame 33A by means of a cover 82 so as to be movable in the direction indicated by the arrow Q.

The second cover member 76 is provided with a cushion 78. When the second cover member 76 is shut down, the first cover member 75 is pressed by the second cover member 76 with the cushion 78 between them. Accordingly, the magnetic toner can entirely be kept from scattering from a gap between the first cover member 75 and the supply opening 33*a*. Further, the second cover member 72 can be taken off by rocking it in the direction indicated by an arrow R after sliding the slider 77*a* against the urging force of the coil spring 77*b*. If undone, the second cover member 76 can then cover the convergent light transmitting body 22, so that magnetic toner scattered at the supply through the supply opening 33*a*, if any, will never soil the convergent light transmitting body 22 or other members. Further, since the supply opening 33*a* can be covered with the second cover member 76 at the supply of the magnetic toner, scattering of the magnetic toner in the vicinity of the opening 33*a* will not constitute any hindrance to the copying operation.

Provided at the toner storage section 33*c*, moreover, is a toner sensor 79 (see FIG. 5) for detecting reduction of the amount of residual magnetic toner stored in the toner storage section 33*c* to a predetermined level. Since any suitable conventional means may be used for the toner sensor 79, detailed description of its construction is omitted herein. The sensing section of the toner sensor 79 is disposed on the same plane with the inner side of the first casing 34. This is done lest the magnetic toner stored in the toner storage section 33*c* should be prevented from being circulated in the clockwise direction of FIG. 5 by the rotatory force of the sleeve 39 in the direction indicated by the arrow F and the magnetic force of the magnet roller 42. Thus, the use of the toner sensor 79 may facilitate the maintenance of proper circulation of the magnetic toner, thereby ensuring satisfactory development.

As shown in FIG. 5, moreover, a cover 80 fitted with a seal member 80*a* is disposed at the developing opening section 33*b* in the vicinity of the photosensitive drum 18, so that the magnetic toner is kept from scattering at development. As shown in FIG. 6, furthermore, seal members 81A and 81B are disposed between the side frames 36A and 36B, respectively, and the sleeve 39. Accordingly, the magnetic toner will never leak out through those intermediate spaces.

It is to be understood that the above-mentioned embodiment is given as a mere example, and that the several members used therein may be replaced with other suitable members having the same functions.

In the developing device of the present invention, as is evident from the above description, the magnetic toner may be prevented from scattering therefrom by the use of the leakage preventive member, and thus the reliability of the picture formation process, as well as the resolution of pictures obtained thereby, can be improved.

What we claim is:

1. A developing device which develops by using a magnetic developer on an electrostatic latent image formed on an image carrier, said developing device comprising:

a body frame having a storage section storing said magnetic developer;

supply means disposed inside the body frame and including a hollow cylindrical rotating body, made of a nonmagnetic material, having a first section facing said storage section and a second section facing said image carrier, and a magnet roller, fitted in the hollow cylindrical body, having a plurality of north and south poles alternately arranged at equal spaces around the roller for generating a shifting magnetic field as the roller is rotated, said supply means supplying the magnetic developer in the storage section to the second section through the shifting magnetic field, whereby the magnetic developer supplied to the second section by said supply means is attracted to the electrostatic latent image on the image carrier; and scattering preventive means provided in said frame body for preventing scattering of a portion of the magnetic developer which passes between a nip formed by the supply means and the image carrier without adhering to the electrostatic latent image and which drops from the supply means and thus has no part in the developing operation, said scattering preventive means including a plate member formed of a nonmagnetic material disposed under said supply means for receiving at its top surface said portion of magnetic developer dropped from the supply means, said shifting magnetic field causing said portion of magnetic developer to move along the top surface of said plate in a first direction until it reaches the edge of said plate whereupon it is transported to the under surface of said plate and said shifting magnetic field causing said portion of magnetic developer to move along the under surface of said plate in a direction opposite to said first direction until it reaches the other edge of said plate whereupon it is transported to the top surface of said plate and as said portion of magnetic developer accumulates on said top surface said shifting magnetic field causes it to collect in said storage section.

2. The developing device according to claim 1, wherein said plate member is formed of a flat plate disposed substantially horizontally.

* * * * *